United States Patent [19]

Kohler

[11] Patent Number: 5,002,705

[45] Date of Patent: Mar. 26, 1991

[54] CARBURETOR INCLUDING AN IDLING ADJUSTMENT SYSTEM

[75] Inventor: Gisbert Kohler, Dettingen, Fed. Rep. of Germany

[73] Assignee: Walbro GmbH, Nurtingen, Fed. Rep. of Germany

[21] Appl. No.: 467,005

[22] Filed: Jan. 18, 1990

[30] Foreign Application Priority Data

Jan. 20, 1989 [DE] Fed. Rep. of Germany ..... 3901627

[51] Int. Cl.[5] ..... F02M 3/06

[52] U.S. Cl. ..... 261/35; 261/121.4; 261/52; 261/41.5; 261/DIG. 38; 261/DIG. 68

[58] Field of Search ..... 261/121.4, 52, 41.5, 261/DIG. 68, 35, DIG. 38

[56] References Cited

U.S. PATENT DOCUMENTS

| | | | |
|---|---|---|---|
| 1,510,293 | 9/1924 | Baverey | 261/121.4 |
| 1,875,713 | 9/1932 | Dusevoir | 261/121.4 |
| 2,208,317 | 7/1940 | Beck | 261/121.4 |
| 2,216,677 | 10/1940 | Schuttler | 261/121.4 |
| 2,243,072 | 5/1941 | Abramson | 261/121.4 |
| 3,454,264 | 7/1969 | Sarto | 261/121.4 |
| 3,608,874 | 9/1971 | Beckmann | 261/41.5 |
| 3,931,372 | 1/1976 | Pierlot | 261/41.5 |
| 3,937,766 | 2/1976 | Garcea et al. | 261/41.5 |
| 4,283,354 | 8/1981 | Schauer et al. | 261/41.5 |
| 4,578,228 | 3/1986 | Gerhardy | 261/41.5 |

FOREIGN PATENT DOCUMENTS

| | | | |
|---|---|---|---|
| 3339714 | 5/1985 | Fed. Rep. of Germany | 261/41.5 |
| 46-43578 | 12/1971 | Japan | 261/121.4 |

*Primary Examiner*—Tim Miles

*Attorney, Agent, or Firm*—Barnes, Kisselle, Raisch, Choate, Whittemore & Hulbert

[57] ABSTRACT

A mechanism for idling position adjustment of a diaphragm carburetor will be described. The carburetor includes an idling nozzle which receives a fuel/air emulsion from an emulsifying chamber under idling conditions. The emulsifying chamber receives fuel from a fuel chamber and air from an acceleration port opening into the mixing passage. Furthermore, the emulsifying chamber communicates via a flow control valve to a venting port opening into the mixing passage. The flow control valve is coupled to the shaft of the throttle valve via mechanical connection means so that the idle position of the throttle valve is varied in accordance with manual adjustments of the flow control valve. This allows to adjust the fuel/air ratios under idling conditions by means of a single adjustment member.

9 Claims, 1 Drawing Sheet

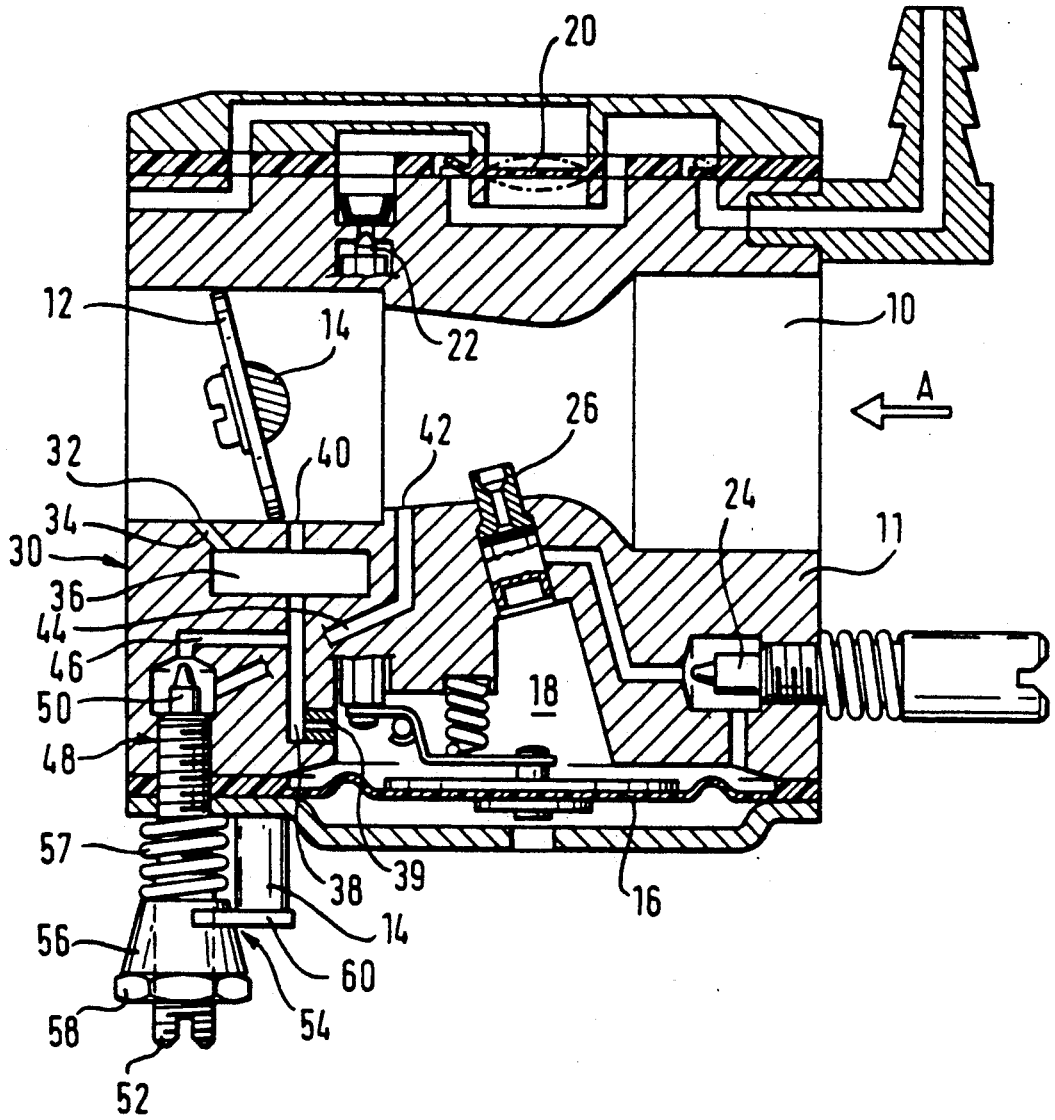
20
12
14
22
10
A
26
42
40
32
24
34
11
30
36
44
46
18
50
48
57
39
38
16
14
56
60
58
54
52

CARBURETOR INCLUDING AN IDLING ADJUSTMENT SYSTEM

The present invention relates to an idling adjustment system for a carburetor for internal combustion engines, in particular a diaphragm carburetor for small engines.

Carburetors for small engines generally include a pair of adjusting members for adjusting the fuel/air mixture during idling operation, i.e. an abutment member for varying the idling position of the throttle valve in order to vary the air flow rate and a flow control valve for varying the rate of fuel flow through the idling nozzle. For an adjustment of the idling speed of the combustion engine it is necessary to operate both adjusting members. Since there is only one position of each of the adjusting members for each idling speed to provide an optimum fuel air mixture, idling adjustment of such a carburetor is relatively complicated in particular for unskilled persons.

German printed application 33 39 714 discloses an apparatus for adjusting engine idling speed, wherein a single adjusting member serves to adjust the air and fuel rates for idling operation. In this prior art apparatus an idling adjusting member associated with the flow control valve member extends into the space between the throttle valve and the adjacent mixing passage wall. If the flow control valve is manually adjusted, the idling adjusting member is simultaneously displaced more or less into the space between the throttle valve and the air mixing passage so that the air flow cross section is changed to conform to the fuel rate without changing the idling position of the throttle valve. The idling adjusting member extending into the mixing passage and a recess of the throttle valve receiving the idling adjusting member seriously affect flow resistance characteristics of the mixing passage. Furthermore, the structure of the prior art carburetor is relatively complicated due to the idling adjusting member.

It is an object of the present invention to provide a carburetor including an idling adjustment system which is of simple operation and structure and has no detrimental affect on the flow characteristics of the mixing passage.

According to the present invention a carburetor, a mixing passage having a throttle member therein, a fuel chamber in communication with the mixing passage via a main nozzle system and an idling nozzle system, the idling nozzle system including an emulsifying chamber in communication with at least one idling nozzle connected to said fuel chamber to receive fuel therefrom and connected to an acceleration port and a venting port to receive air therefrom, said idling nozzle opening into the mixing passage downstream of the throttle member and said acceleration port opening into said mixing passage at an area over which the throttle member sweeps when it is operated and further including flow control valve means for varying the rate of air flow from said venting port to the emulsifying chamber, is characterized in that the flow control valve means is coupled to the throttle member by connection means so that the position of the flow control valve and the idling position of the throttle member are adjustable by a single manually actuatable adjusting member.

Due to the connection means between the flow control valve and the throttle member it is only one adjusting member that needs to be actuated in order to simultaneously vary the flow cross section of the flow control valve and the angular position of the throttle valve in order to adjust the idling speed of the combustion engine. The connection between the flow control valve and the throttle valve is arranged so that each position of the flow control valve has associated therewith a predetermined idling position of the throttle member. In this manner an optimum fuel air mixture for each idling speed of the combustion engine is ensured; in particular this allows to obtain a constant fuel/air mixture.

Since the connection between the flow control valve and the throttle member is disposed outside of the mixing passage, it does not affect the flow characteristics of the mixing passage. In particular, the throttle valve may be of conventional shape. The connection between the flow control valve and the throttle member may be of extremely simple structure. In particular the conection may comprise a mechanical connection; alternatively it could comprise a hydraulic or electrical connection.

In a preferred embodiment of the invention the mechanical connection comprises a conical member mounted to the adjusting member, which conical member serves as an abutment for an extension of the throttle valve shaft.

With reference to the single drawing a preferred embodiment of the present invention will be explained in detail. The drawing is a schematic cross section of a diaphragm carburetor including a mechanism for adjusting the idling speed of an internal combustion engine (not shown).

The carburetor shown in the drawing, which may be used in motor saws or the like, includes a mixing passage 10 provided in a casing 11 and including a flow restriction.

Mixing passage 10 includes a rotatable throttle valve 12 arranged downstream of the flow restriction and mounted to a rotatable shaft 14. As indicated by arrow A air may flow through the mixing passage 10, with the air rate being dependent on the angular position of the throttle valve 12.

Furthermore the carburetor includes a diaphragm 16, one side of which is subjected to atmospheric pressure and the other side of which limits a fuel chamber 18. The fuel chamber 18 receives fuel from a fuel pump 20 via a valve 22 controlled by diaphragm 16.

Fuel chamber 16 communicates with a main nozzle 26 via a manually adjustable regulating valve 24. Main nozzle 26 opens into mixing passage 10 at its flow restriction area and delivers fuel to the mixing passage due to the suction pressure prevailing in mixing passage 10 during normal operation.

Furthermore the carburetor includes an idling nozzle system 30. Idling nozzle system 30 includes an idling nozzle 32 opening into mixing passage 10 downstream of throttle valve 12. Idling nozzle 32 communicates with an emulsifying chamber 36 via a line 34. Emulsifying chamber 36 communicates with fuel chamber 16 by a line 38 and a (fixed or adjustable) nozzle 39. Furthermore emulsifying chamber 36 communicates with an acceleration port 40 opening into mixing passage 10 at an area which is upstream of the throttle valve 12 when the throttle valve is in its closed position and which the throttle valve 12 passes by when it is moved towards its opening position for acceleration of the combustion engine.

Under idling condition of the combustion engine throttle valve 12 is in a nearly closed position. The low air flow velocities upstream of throttle valve 12 resulting therefrom will not be sufficient to induce fuel from main nozzle 26. On the other hand idling nozzle 32 is subjected to suction pressure of the combustion engine. As a result thereof emulsifying chamber 36 receives fuel from fuel chamber 18 and air via acceleration port 40. Emulsifying chamber 36 provides a fuel/air foam which flows through idling nozzle 32 into the mixing passage and from there to the combustion engine.

The carburetor includes means for adjusting the idling speed of the combustion engine. To this end a venting port 42 opening into mixing passage 10 is provided between acceleration port 40 and main nozzle 26 (as seen in flow direction). Venting port 42 is in fluid communication with emulsifying chamber 36 through lines 44, 46 via a flow control valve 48. Line 46 opens into line 38; alternatively, it could extend directly to emulsifying chamber 36.

Flow control valve 48 includes a valve needle 50 which is axially displaceable in order to control the flow rate of air flowing from venting opening 40 to emulsifying chamber 36. Valve needle 50 is connected to an adjusting member 52 comprising a threaded member extending outwardly from casing 11 and adapted to be manually rotated (e.g. by a screwdriver) in order to axially adjust valve needle 50. Flow control valve 48 is coupled to shaft 14 of throttle valve 12 via a mechanical connection means 54. In order to show mechanical connection means 54 in the drawing, flow control valve 48 and the associated end of throttle valve shaft 14 have been rotated about 90°. Actually flow control valve 48 is arranged so that its axis extends parallel to the axis of throttle valve shaft 14. Mechanical connection means 54 includes a conical member 56 mounted on threaded member 52 by concentric threads so as to be longitudinally displaceable and urged against a counternut 58 by resilient means 57 supported against casing 11.

The associated end of throttle valve shaft 14 has a lateral extension 60 resiliently urged in engagement with conical member 56 so as to define the idling position of throttle valve 12.

When for an adjustment of the idling speed of the engine adjusting member 52 and accordingly valve needle 50 of flow control valve 48 are moved in a direction towards the interior of casing 11, the flow rate of air flowing from venting port 42 to emulsifying chamber 36 is reduced. From this results an increase of the fuel proportion in the air/fuel foam fed from idling nozzle 32 to the combustion engine. Such an adjustment of flow control valve 48 causes, via conical member 56 and extension 60, a rotation of throttle valve shaft 14 so as to move throttle valve 12 towards its open position. Accordingly the combustion engine receives not only additional fuel but also additional air.

By adapting the shape of conical member 56 to the characteristics of flow control valve 48 it may be ensured that the fuel air mixture will be kept at an optimum during idling speed adjustments. As an example, the air/fuel ratio may be kept constant. Nevertheless adjustment of the idling speed requires only a single adjusting member.

As already mentioned conical member 56 is longitudinally displaceable with respect to threaded member 52 and, accordingly, with respect to valve needle 50. This allows to adjust the basic characteristics of the idling system.

While connection system 54 has been shown to be of mechanical nature, alternatively it could comprise hydraulic or electrical means. Venting port 42, which has been shown to open into mixing passage 10 could be arranged to be open to atmosphere. The present invention may be used not only in diaphragm carburetors, but also other types of carburetors, e.g. flow type carburetors. Also, the invention may be used with carburetors having linearly displaceable throttle members.

I claim:

1. A carburetor for an internal combustion engine, including a mixing passage having a throttle member therein, a fuel chamber in communication with the mixing passage via a main nozzle system and an idling nozzle system, the idling nozzle system including an emulsifying chamber in communication with at least one idling nozzle connected to said fuel chamber to receive fuel therefrom and connected to an acceleration port and a venting port to receive air therefrom, said idling nozzle opening into the mixing passage downstream of the throttle member and said acceleration port opening into said mixing passage at an area over which the throttle member sweeps when it is operated and further including flow control valve means for varying the rate of air flow from said venting port to the emulsifying chamber, the flow control valve means (48) being coupled to the throttle member (12) by connection means (54) for adjusting the position of the flow control valve (48) and the idling position of the throttle member (12) by a single manually actuatable adjusting member (52).

2. The carburetor as defined in claim 1 wherein said adjusting member (52) comprises a control member of the flow control valve means (48) coupled to the throttle member (12) by said connection means (54).

3. The carburetor as defined in claim 1 wherein said connection means (54) for coupling the flow control valve means (48) and the throttle member (12) provides a proportional relationship between changes of the rate of airflow through the mixing passage and changes of the rate of fuel flow through the idling nozzle (32).

4. The carburetor as defined in claim 1 wherein said connection means (54) comprises a mechanical connection.

5. The carburetor as defined in claim 4 wherein said mechanical connection (54) comprises cam means.

6. The carburetor as defined in claim 4 wherein the throttle member (12) comprises a rotatable throttle valve and said mechanical connection (54) includes a conical member (56) mounted to said adjusting member (52), said conical member serving as an abutment for an extension (60) of a shaft (24) of the throttle valve (12).

7. The carburetor as defined in claim 6 wherein said conical member (56) is adjustable relative to said adjusting member (52).

8. The carburetor as defined in claim 6 wherein said adjusting member comprises a threaded member (52) connected to a valve needle (50) of the flow control valve means, the axis of said threaded member being parallel to the axis of said throttle valve shaft (14) and said conical member (56) being concentrically mounted to said threaded member (52).

9. The carburetor as defined in claim 6 wherein said proportional relationship is provided by selection of the tapering angle of said conical member (56).

* * * * *